US006623318B1

(12) United States Patent
Kantola

(10) Patent No.: US 6,623,318 B1
(45) Date of Patent: Sep. 23, 2003

(54) MARINE PROPULSION ISOLATION SYSTEM FOR CONTROL OF MOTION DUE TO TORQUE AND RELATED METHOD

(75) Inventor: Robert Arvid Kantola, Atkinson, NH (US)

(73) Assignee: General Electric Company, Schenectady, NY (US)

( * ) Notice: Subject to any disclaimer, the term of this patent is extended or adjusted under 35 U.S.C. 154(b) by 237 days.

(21) Appl. No.: 09/724,011

(22) Filed: Nov. 28, 2000

(51) Int. Cl.[7] ..... B63H 21/30

(52) U.S. Cl. ..... 440/52; 248/562; 248/566; 248/636; 440/111

(58) Field of Search ..... 440/52, 111; 248/562, 248/566, 636, 638; 180/312; 114/337, 338

(56) References Cited

U.S. PATENT DOCUMENTS

| | | | | |
|---|---|---|---|---|
| 2,398,174 A | * | 4/1946 | Cedillo | 114/338 |
| 3,982,496 A | | 9/1976 | Blanchard | |
| 4,600,863 A | | 7/1986 | Chaplin et al. | |
| 4,756,513 A | * | 7/1988 | Carlson et al. | 267/140.14 |
| 4,762,306 A | * | 8/1988 | Watanabe et al. | 123/192.1 |
| 4,955,833 A | | 9/1990 | Lam et al. | |
| 4,966,567 A | | 10/1990 | Breckenfeld et al. | |
| 4,979,918 A | | 12/1990 | Breckenfeld | |
| 5,039,073 A | * | 8/1991 | Reichard et al. | 180/291 |
| 5,050,446 A | | 9/1991 | Takashima et al. | |
| 5,062,085 A | | 10/1991 | Andrews, Jr. | |
| 5,083,949 A | | 1/1992 | Breckenfeld et al. | |
| 5,192,235 A | | 3/1993 | Dunham et al. | |
| 5,333,570 A | | 8/1994 | DuBois et al. | |
| 5,360,375 A | | 11/1994 | Falz et al. | |
| 5,372,356 A | | 12/1994 | Luz et al. | |
| 5,460,552 A | | 10/1995 | Blanchard et al. | |
| 5,460,553 A | | 10/1995 | Craig et al. | |
| 5,615,868 A | * | 4/1997 | Murray | 248/638 |
| 5,701,969 A | * | 12/1997 | Stephens | 180/299 |
| 6,024,615 A | | 2/2000 | Eichinger | |
| 6,077,135 A | | 6/2000 | Ito | |
| 6,123,620 A | | 9/2000 | Polakowski | |
| 6,287,159 B1 | | 9/2001 | Polakowski et al. | |

FOREIGN PATENT DOCUMENTS

| | | | | |
|---|---|---|---|---|
| SE | 318202 | * | 8/1969 | 440/111 |

* cited by examiner

*Primary Examiner*—Sherman Basinger
(74) *Attorney, Agent, or Firm*—Nixon & Vanderhye P.C.

(57) ABSTRACT

Torque roll, such as in a marine propulsion unit for driving a propeller, is significantly reduced or substantially eliminated by utilizing inflatable elements, such as airbags. One or more airbags engage the top of a propulsion unit mounting surface supported by an elastomeric isolation mount where a torque roll force is substantially upward, and one or more other airbags engage the bottom of a mount for the propulsion unit at a location where the torque roll force is substantially downward. The amount of gas supplied to the airbags is preferably substantially proportional to the torque roll force at each of the airbags. By significantly reducing or substantially eliminating the torque roll of the propulsion unit, the unit can be connected to other components without line shaft couplings.

28 Claims, 3 Drawing Sheets

Fig. 1 (Prior Art)
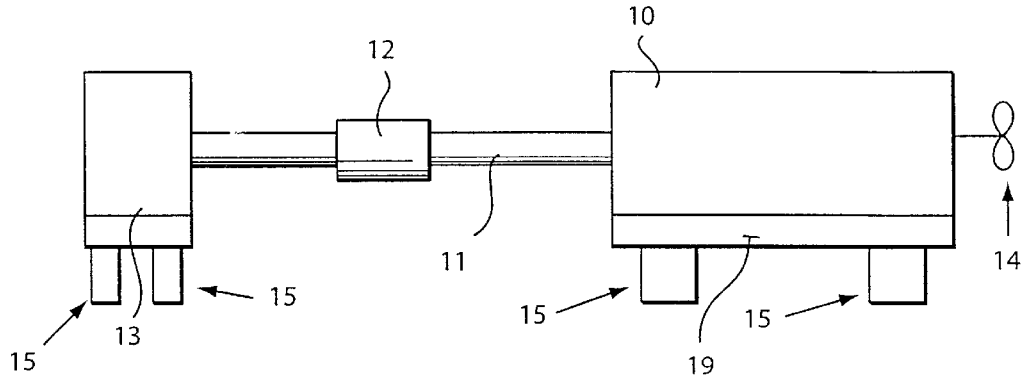
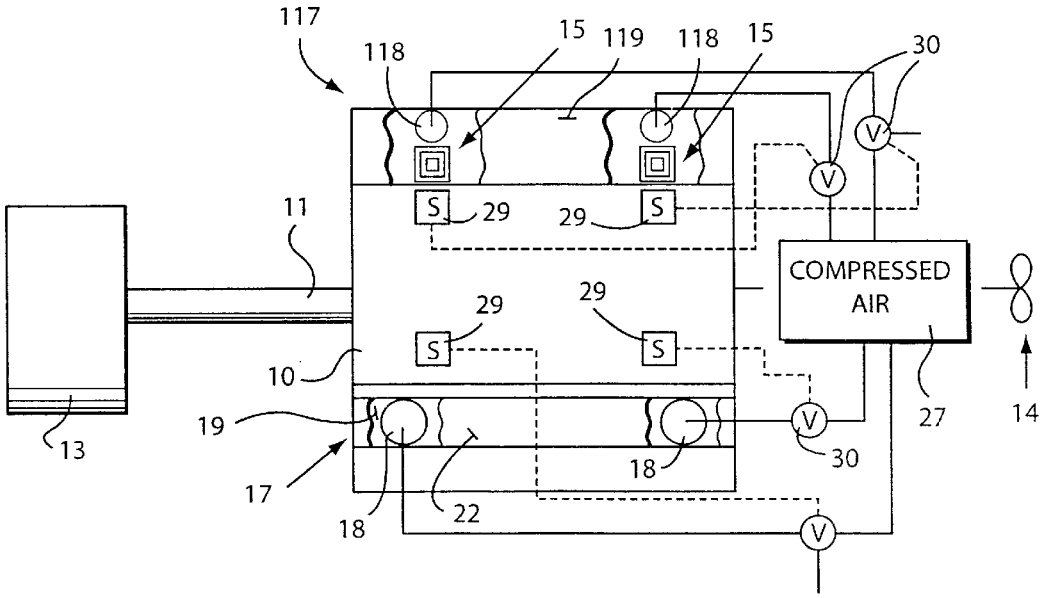
Fig.2

MARINE PROPULSION ISOLATION SYSTEM FOR CONTROL OF MOTION DUE TO TORQUE AND RELATED METHOD

This invention relates to machinery subject to torque loads and, specifically, to a mounting assembly that reduces or eliminates torque roll associated with soft, passive machinery mounts.

BACKGROUND OF THE INVENTION

There are many pieces of machinery that are subject to torque loads which cause misalignment between machinery components, and/or require couplings with misalignment capability. At high speeds, rotating elements of machinery can apply high torque loads to mounts for the machinery, these torque loads typically referred to as causing "torque roll", an undesirable situation. The normal manner to accommodate torque roll is simply to provide expensive and space-consuming line shaft couplings which accommodate misalignment in machinery components due to torque roll caused by high torque forces.

Current submarine designs use hard mounting of the main propulsion components to minimize misalignment due to high torque loads. Unfortunately, this approach provides a direct unattenuated path for noise transmission and is a serious drawback to extremely quiet operation.

Advanced submarine designs use elastomeric mounts to provide noise isolation between the propulsion machinery and rest of the structure. At high speeds the overturning moment from the high line shaft torque can cause one side of the machinery to lift. This places the elastomeric isolators on one side in tension, a design condition that is not allowed. In addition, the misalignment at high torque forces the use of the expensive and space consuming line shaft coupling mentioned above.

That is, current practice uses the weight of the main propulsion unit [MPU] to keep the lifting side mounts in compression. However, for advanced submarines, reduced MPU weight and narrower athwartship mounting locations can cause the mounts to unload. Regular elastomeric mounts have been proposed to be used on one side in an over/under configuration with the "over" mounts in compression under torque roll. Used in this fashion they have to be pre-compressed so that the under mounts do not unload during high torque loads. This pre-compression will cause the permanent deformation, due to creep, to occur earlier and shorten service life. Additionally, the low speed noise isolation will be reduced as the addition of the upper mounts will increase the mount spring constant and cause the basic system resonance frequency to increase and thereby reduce the frequency difference between the noise stimuli and the basic system resonance. This will also reduce the noise isolation attenuation with respect to an "all under" mount configuration.

SUMMARY OF THE INVENTION

According to the present invention, a mounting assembly is provided which significantly reduces or substantially eliminates torque roll of soft passive mounts for machinery (such as elastomeric isolation units), without compromising the isolation performance or the service life of the mounts. The invention achieves this advantage in a simple yet effective manner but can be used in a wide variety of different ways, with different equipment, to get desired results over extended periods of time. While applicable to a wide variety of machinery, the invention is particularly suitable for use in marine applications, such as in submarines.

According to one aspect of the present invention there is provided a mounting assembly for a device subject to a torque roll force in a generally upward first direction on a first side of the device, and a torque roll force in a generally downward second direction on a second side of the device, comprising: At least one soft passive mount for the device on each of the first and second sides, below and operatively engaging at least a portion of the device; and a first inflatable element disposed at or adjacent the first side of the device and resisting movement of the device in response to the torque roll force in the first direction.

Preferably the first inflatable element provides a counter-force to the torque roll force in the first direction substantially proportional to the torque roll force in the first direction. For example, the first inflatable element may comprise at least one airbag operatively connected to a source of compressed gas. The assembly may further comprise means for adjusting the pressure of gas in the at least one airbag in response to the level of the torque roll force in the first direction. Typically, the first inflatable element is mounted between a substantially stationary support element and an upper surface of a portion of the device to apply a substantially downwardly directed force to the device counter to the torque roll force in the first direction.

The invention also preferably further comprises a second inflatable element operatively engaging the device at or adjacent the second side thereof and resisting movement of the device in response to the torque roll force in the second direction. Desirably the second inflatable element provides a counter-force to the torque roll force in the second direction substantially proportional to the torque roll force in the second direction. For example, the second inflatable element may also comprise at least one airbag operatively connected to a source of compressed gas, and the assembly may further comprise means for adjusting the pressure of gas in the at least one airbag in response to the level of the torque roll force in the second direction. Typically, the second inflatable element is mounted below a portion of the device at the second end of the device. A wide variety of conventional soft passive mounts may be utilized, such as elastomeric isolation mounts. Also the device may comprise a wide variety of different types of equipment or machinery, such as a propulsion unit or a component of a propulsion unit. By practicing the invention, typically a rotatable shaft connected to the propulsion unit, or component of the propulsion unit, can be connected to another unit without expensive and space-consuming conventional line shaft couplings described above. The invention is particularly applicable where the propulsion unit or component of the propulsion unit [such as an MPU or gearing for an MPU] is a marine unit for driving a propeller, such as a submarine propeller.

According to another aspect of the present invention an assembly is provided comprising: A device having first and second sides having first and second mounting elements. At least one soft passive mount for the device below and operatively engaging each of the first and second mounting elements. A first inflatable element mounted between a substantially stationary support element and an upper surface of the first mounting element, and when inflated applying a substantially downward force on the first mounting element. And a second inflatable element operatively engaging the second mounting element below the second mounting element, and when inflated applying a substantially upward force on the first mounting element.

Typically, each of the inflatable elements is operatively connected to a source of compressed gas, and applies a force substantially proportional to an opposite force applied thereto. The device, and the passive mounts, etc., may be as described above, with the first side of the device to starboard and the second side to port.

According to another aspect of the present invention there is provided a method of reducing or substantially eliminating torque roll of a propulsion element, having first and second sides mounted by soft passive mounts, wherein the element is subject to a torque roll force in a generally upward first direction on the first side of the element, and a torque roll force in a generally downward second direction on the second side of the element, the method utilizing at least one inflatable element, and comprising: a) Directly or indirectly sensing the torque roll force in at least one of the first and second directions. And b) in response to a), controlling the pressure of gas in the at least one inflatable element to resist at least one of the torque roll forces in the first and second directions.

Preferably the method as described above utilizes first and second inflatable elements mounted at or adjacent each of the first and second sides of the propulsion element, and a) and b) are practiced to resist torque roll forces in both the first and second directions. Also, preferably b) is practiced to provide resistive forces substantially proportional to the torque forces in both the first and second directions. For example, the propulsion element may be a marine propulsion element operatively connected to a propeller, and the method may further comprise c) driving the propeller, including at least in part with the propulsion element, to power a marine vessel containing the propulsion element.

BRIEF DESCRIPTION OF THE DRAWINGS

FIG. 1 is a side schematic view of an exemplary prior art on unit mounted by elastomeric isolation mounts;

FIG. 2 is a top schematic view of an assembly according to the present invention similar to the prior art of FIG. 1 only controlling, significantly reducing, or substantially eliminating, torque roll;

DETAILED DESCRIPTION OF THE INVENTION

Figure 3:
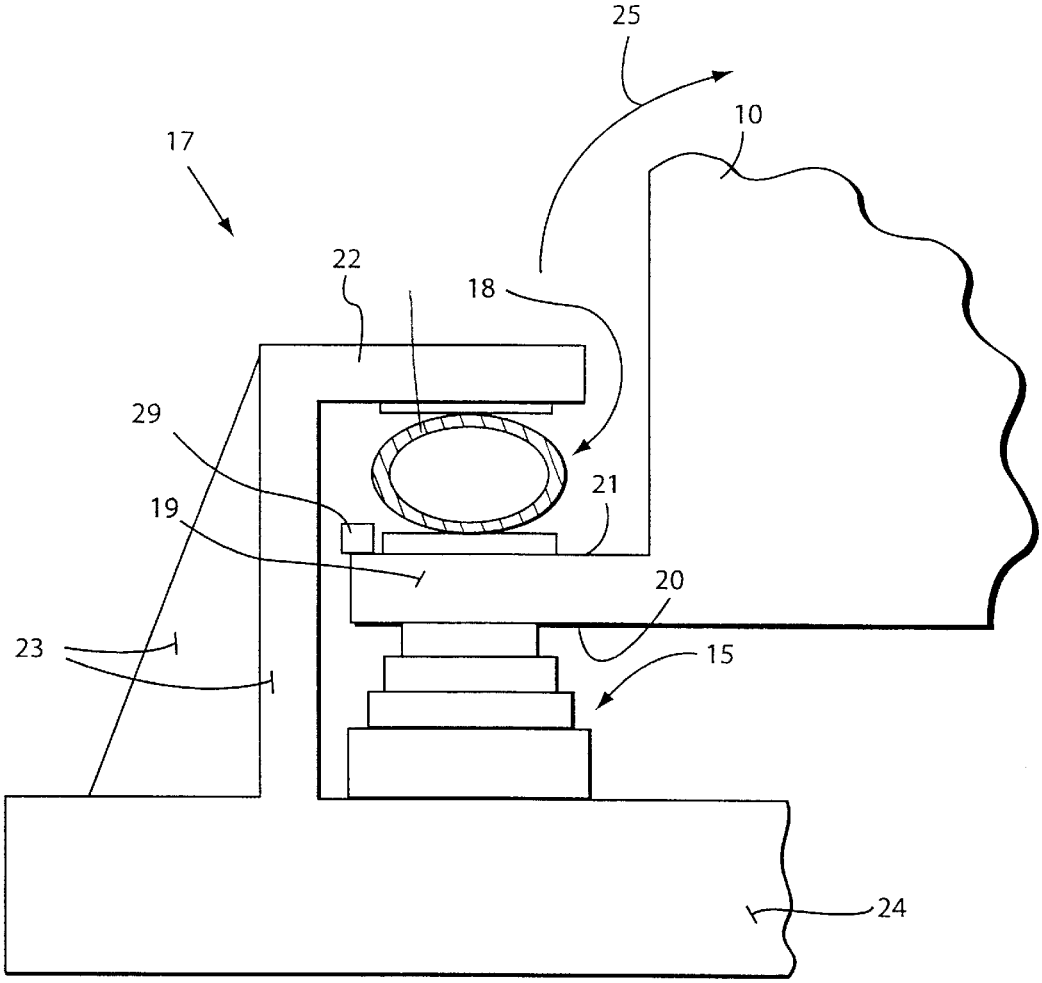
FIG. 3 is a detailed schematic end view of the first side of the device of FIG. 2 showing a mounting arrangement according to the present invention.

FIG. 1 shows an exemplary propulsion unit component 10, such as connected by a rotatable shaft 11 through a line shaft coupling 12 to another propulsion unit component 13. For example, the component 13 may be a main propulsion unit of a marine vessel, such as a submarine, and the component 10 may be a gear assembly, which ultimately drives a propeller shown schematically at 14 in FIG. 1. The units 10, 13 are typically mounted by conventional soft passive mounts, such as elastomeric isolation mounts, shown schematically at 15 in FIG. 1.

Figure 4:
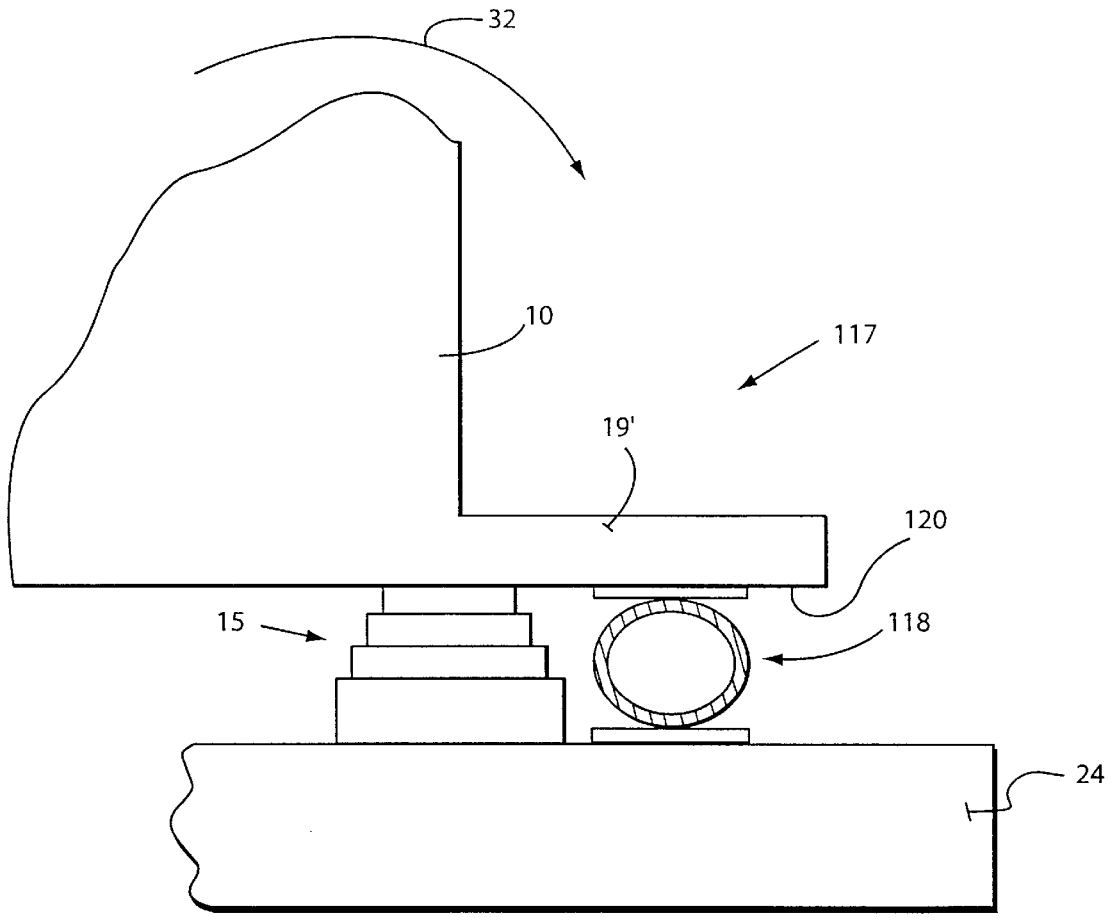
FIG. 4 is a view like that of FIG. 3 only showing the opposite side of the device of FIG. 2.

FIG. 2 schematically illustrates in top view, with portions cut away for clarity of illustration of various components according to the invention, an assembly similar to the prior art arrangement of FIG. 1 but utilizing the features of the invention, shown in more detailed in FIGS. 3 and 4. In FIGS. 2 through 4 components that are the same as or comparable to those in FIG. 1 are shown by the same reference numeral. Note that when practicing the invention as illustrated in FIG. 2 typically a line shaft coupling 12, such as illustrated in FIG. 1 is not necessary because there will not be significant misalignment due to torque roll.

The component 10 comprises a first side 17, and a second side 117. In addition to the conventional elastomeric isolation mount 15 operatively engaging (in any conventional manner, either directly or indirectly) the unit 10 at or adjacent the first side 17, at least one inflatable element 18 is provided. For example, the elements 15, 18 may act on a mounting element 19 at the first side 17 of the unit 10. The soft passive mount (such as an elastomeric isolation mount) 15 operatively engages the bottom surface 20 of the mounting element 19, while the inflatable element 18 operatively engages the top surface 21. Operatively engaging the top of the inflatable element 18 is a substantially stationary support element 22, which can be connected via vertical support components 23 to the same floor, deck, or sub-base 24 as the isolation mount 15.

The inflatable element 18 resists or counters the torque roll force 25 (see FIG. 3) in a generally upward first direction.

While the inflatable element 18 may have a wide variety of constructions, preferably it is a conventional airbag or bladder of flexible material, and preferably at least in part of elastomeric material, and which is capable of exerting a force between the components 19, 22 that successfully controls, significantly reduces, or substantially eliminates torque roll as a result of the force 25 thereby—in addition to other advantageous results—extending the life of the elastomeric isolation mount 15.

Any number of air bags 18 may be provided, and any sizes. In the exemplary embodiment illustrated in FIG. 2, two spaced airbags 18 are provided, each over an elastomeric isolation mount 15, but one or three or more airbags could be provided.

As seen schematically in FIG. 2, the airbags 18 are desirably connected to a source of compressed gas, such as air, 27. The compressed air source 27 may be a compressor, a compressed air tank, an accumulator, or a wide variety of other conventional structures. Where more than one airbag 18 is provided, the airbags may be separately connected to the compressed air source 27—as schematically illustrated in FIG. 2—or connected through a common conduit, especially where the torque roll forces will be substantially uniform along the first side 17 of the unit 10.

Preferably, the airbag 18 has means for adjusting the pressure of gas in the airbag 18 in response to the level of torque roll force 25, to provide a force which resists or counters the torque roll force 25 which is substantially proportional to the torque roll force 25, so as to significantly reduce or substantially eliminate torque roll as a result of the force 25. This proportional resistive or counter force is provided by controlling the pressure of the gas in the airbag 18 in response t o the torque roll force 25. While the pressure of the gas in the airbags 18 may be controlled manually or empirically to achieve these results, the results also may be achieved automatically, For example, as schematically illustrated in FIG. 2, the pressure adjuster means may include sensors 29 operatively connected to three-way valves 30, which are in turn connected between the airbags 18 and the compressed gas supply 27. The sensors 29 may directly or indirectly sense the force 25, and then control the valves 30 to either allow further compressed gas from source 27 to flow into the airbags 18, or to vent some of the gas from the airbags 18, or to close the valves 30 entirely so that the pressure of gas in the airbags 18 remains substantially constant.

The valves 30 may be any suitable conventional valves for this purpose. The sensors 29 may also be any suitable conventional or hereafter developed sensors that are capable of sensing the torque roll force 25 such as a tilt switch (see the mount of the sensor 29 in the exemplary embodiment of FIG. 3) mounted at the far end of the mounting element 19, a piezoelectric element sensing stress in the isolation mount 15, an optical element sensing even slight upward movement of the end of the element 19 or any other like device; or the sensors 29 may be conventional torque sensors, or the valves 30 may be controlled simply in response to shaft speed squared (for marine propulsion units driving propellers 14). Conventional processors or computer controls may also be provided, and the various components may be hard wired or may have wireless interconnections. Other types of valves, fluidic components, gas sources, or the like, may also be provided as, or as part of, the pressure adjusting means, as long as the end results desired are accomplished.

According to the present invention it is also desirable to provide a complementary component on the second side 117 of the unit 10, as seen in both FIGS. 2 and 4, to assist in resisting or countering torque roll forces, such as the torque roll force in a second generally downward direction illustrated schematically at 32 in FIG. 4. As seen in FIG. 4, at least one second inflatable element, such as the airbag(s) 118, is/are provided at or adjacent the second end 117. The at least one second inflatable element 118 operatively engages the bottom surface 120 of the mounting element 1 19 at the second side 117 of the unit 10, and pushes upwardly on the mounting element 119 to resist or counter the torque roll force 32. In this case too, sensors 29 and control valves 30 may be provided for cooperating with the airbags 118 to supply a force counter or resistive to the torque roll force 32 that is substantially proportional to the force 32.

In conventional submarine application, the first side 17 is to starboard, and the second side 1 17 is to port, however, for other ships which have counter rotating propellers the structures as illustrated in FIG. 3 or 4 will be utilized on whatever side is necessary or desirable in order to accommodate the desired results considering the normal direction of rotation of the propeller 14. For other machinery applications where the output shaft from the unit 10 may be able to rotate in both directions, units such as illustrated in both FIGS. 3 and 4 may be provided on both sides of the unit 10.

Practicing the invention, misalignment between interconnected equipment, for example, between a turbine and gears in a main propulsion unit, is controlled, significantly reduced, and/or substantially eliminated, in fact so that the line shaft couplings 12 typically do not need to be used. Also, the invention is advantageous in that the isolation performed by the basic elastomeric units 15 will only be minimally affected. At low speeds, when the major stimuli frequencies are close to the element 15's resonance, the airbags 18, 118 will only be light pressurized and the system resonance will be very close to what the elastomeric elements 15 provide. Another advantage of the invention is that it does not result in any increase in the loading of the elastomeric mounts 15 other than seen under static conditions. This minimizes permanent deformations, due to creep, that cause replacement of the elastomeric mounts on a regular basis. Because they are deflatable, the airbags 18, 118 will also be relatively easy to install or replace.

It will thus be seen that according to the present invention torque roll is significantly reduced or substantially eliminated in a simple yet effective manner, one that is both efficient and cost effective.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A mounting assembly for a device subject to a torque roll force in a generally upward first direction on a first side of the device, and a torque roll force in a generally downward second direction on a second side of the device, comprising:

at least one soft passive mount for said device on each of said first and second sides, below and operatively engaging at least a portion of said device; and a first inflatable element disposed at or adjacent said first side of said device and resisting movement of said device in response to said torque roll force in said first direction.

2. An assembly as recited in claim 1 wherein said first inflatable element provides a counter-force to said torque roll force in said first direction substantially proportional to said torque roll force in said first direction.

3. An assembly as recited in claim 2 further comprising a second inflatable element operatively engaging said device at or adjacent said second side thereof and resisting movement of said device in response to said torque roll force in said second direction.

4. An assembly as recited in claim 3 wherein said second inflatable element provides a counter-force to said torque roll force in said second direction substantially proportional to said torque roll force in said second direction.

5. An assembly as recited in claim 4 wherein said device comprises a submarine propulsion unit or a component of a propulsion unit, for driving a submarine propeller.

6. An assembly as recited in claim 1 wherein said first inflatable element comprises at least one airbag operatively connected to a source of compressed gas.

7. An assembly as recited in claim 6 further comprising means for adjusting the pressure of gas in said at least one airbag in response to the level of said torque roll force in said first direction.

8. An assembly as recited in claim 1 wherein said first inflatable element is mounted between a substantially stationary support element and an upper surface of a portion of said device to apply a substantially downwardly directed force to said device counter to said torque roll force in said first direction.

9. An assembly as recited in claim 1 further comprising a second inflatable element operatively engaging said device at or adjacent said second side thereof and resisting movement of said device in response to said torque roll force in said second direction.

10. An assembly as recited in claim 9 wherein said second inflatable element provides a counter-force to said torque roll force in said second direction substantially proportional to said torque roll force in said second direction.

11. An assembly as recited in claim 9 wherein said second inflatable element comprises at least one airbag operatively connected to a source of compressed gas.

12. An assembly as recited in claim 11 further comprising means for adjusting the pressure of gas in said at least one airbag in response to the level of said torque roll force in said second direction.

13. An assembly as recited in claim 9 wherein said second inflatable element is mounted below a portion of said deviceat said second end of said device.

14. An assembly as recited in claim 1 wherein said soft passive mounts comprise elastomeric isolation mounts.

15. A mounting assembly for a device subject to a torque roll force in a generally upward first direction on a first side of the device, and a torque roll force in a generally downward second direction on a second side of the device, comprising:

at least one soft passive mount for said device on each of said first and second sides, below and operatively engaging at least a portion of said device; and a first inflatable element disposed at or adjacent said first side of said device and resisting movement of said device in response to said torque roll force in said first direction;

wherein said device comprises a propulsion unit or a component of a propulsion unit connected by a rotatable shaft to another unit without line shaft couplings.

16. An assembly as recited in claim 15 wherein said propulsion unit or a component of a propulsion unit comprises a marine propulsion unit or a component of a propulsion unit, for driving a propeller.

17. An assembly as recited in claim 16 wherein said propulsion unit or a component of a propulsion unit is mounted in a submarine, and wherein said first side of said device is to starboard, and said second side of said device is to port.

18. An assembly comprising:

a device having first and second sides having first and second mounting elements;

at least one soft passive mount for said device below and operatively engaging each of said first and second mounting elements;

a first inflatable element mounted between a substantially stationary support element and an upper surface of said first mounting element, and when inflated applying a substantially downward force on said first mounting element; and a second inflatable element operatively engaging said second mounting element below said second mounting element, and when inflated applying a substantially upward force on said first mounting element.

19. An assembly as recited in claim 18 wherein each of said inflatable elements is operatively connected to a source of compressed gas, and applies a force substantially proportional to an opposite force applied thereto.

20. An assembly as recited in claim 18 wherein said soft passive mounts comprise elastomeric isolation mounts.

21. An assembly comprising:

a device having first and second sides having first and second mounting elements;

at least one soft passive mount for said device below and operatively engaging each of said first and second mounting elements;

a first inflatable element mounted between a substantially stationary support element and an upper surface of said first mounting element, and when inflated applying a substantially downward force on said first mounting element; and a second inflatable element operatively engaging said second mounting element below said second mounting element, and when inflated applying a substantially upward force on said first mounting element;

wherein said device comprises a propulsion unit or a component of a propulsion unit connected by a rotatable shaft to another unit without line shaft couplings.

22. An assembly as recited in claim 21 wherein said propulsion unit or a component of a propulsion unit comprises a marine propulsion unit or a component of a propulsion unit, for driving a propeller.

23. An assembly as recited in claim 21 wherein said propulsion unit or a component of a propulsion unit is mounted in a submarine, and wherein said first side of said device is to starboard, and said second side of said device is to port.

24. A method of reducing or substantially eliminating torque roll of a propulsion element, having first and second sides mounted by soft passive mounts, wherein the element is subject to a torque roll force in a generally upward first direction on the first side of the element, and a torque roll force in a generally downward second direction on the second side of the element, said method utilizing at least one inflatable element, and comprising:

a) directly or indirectly sensing the torque roll force in at least one of the first and second directions; and b) in response to a), controlling the pressure of gas in the at least one inflatable element to resist at least one of the torque roll forces in the first and second directions.

25. A method as recited in claim 24 utilizing first and second inflatable elements mounted at or adjacent each of the first and second sides of the propulsion element; and wherein a) and b) are practiced to resist torque roll forces in both the first and second directions.

26. A method as recited in claim 25 wherein b) is practiced to provide resistive forces substantially proportional to the torque forces in both the first and second directions.

27. A method as recited in claim 26 wherein the propulsion element is a marine propulsion element operatively connected to a propeller; and further comprising c) driving the propeller, including at least in part with the propulsion element, to power a marine vessel containing the propulsion element.

28. A method as recited in claim 24 wherein the propulsion element is a marine propulsion element operatively connected to a propeller; and further comprising c) driving the propeller, including at least in part with the propulsion element, to power a marine vessel containing the propulsion element.

* * * * *

UNITED STATES PATENT AND TRADEMARK OFFICE

CERTIFICATE OF CORRECTION

PATENT NO. : 6,623,318 B1
DATED : September 23, 2003
INVENTOR(S) : Kantola

It is certified that error appears in the above-identified patent and that said Letters Patent is hereby corrected as shown below:

Column 3,
Line 34, delete “on unit” and insert -- propulsion unit --.

Column 4,
Line 55, delete “automatically,” and insert -- automatically. --.

Signed and Sealed this

Seventeenth Day of February, 2004

JON W. DUDAS
*Acting Director of the United States Patent and Trademark Office*